United States Patent [19]

Castel et al.

[11] Patent Number: 4,643,616

[45] Date of Patent: Feb. 17, 1987

[54] DEVICE FOR POSITIONING, ACTIVATING AND CONNECTING MODULES OF A SUB-SEA OIL PRODUCTION STATION

[75] Inventors: Yvon Castel; Michel Iato, both of Pau, France

[73] Assignee: Societe Nationale Elf Aquitaine (Production), Paris La Defense, France

[21] Appl. No.: 672,944

[22] Filed: Nov. 19, 1984

[30] Foreign Application Priority Data

Nov. 21, 1983 [FR] France ..... 83 18457

[51] Int. Cl.[4] ..... B63C 11/52; E21B 43/01

[52] U.S. Cl. ..... 405/191; 166/338

[58] Field of Search ..... 405/169, 185, 188, 190, 405/191; 166/338, 341, 360

[56] References Cited

U.S. PATENT DOCUMENTS

| | | | |
|---|---|---|---|
| 3,179,176 | 4/1965 | Goepfert | 166/360 X |
| 3,307,627 | 3/1967 | Shatto | 405/169 X |
| 3,698,197 | 10/1972 | Bodey et al. | 405/188 |
| 4,034,568 | 7/1977 | Mason | 405/188 X |
| 4,043,134 | 8/1977 | Mason | 405/188 |
| 4,167,215 | 9/1979 | Thorne | 166/341 |
| 4,192,383 | 3/1980 | Kirkland et al. | 166/341 |

*Primary Examiner*—David H. Corbin

*Attorney, Agent, or Firm*—Poms, Smith, Lande & Rose

[57] ABSTRACT

A device is provided for positioning, activating and connecting the modules of a sub-sea oil production station. It comprises a frame 1 on which is mounted a central orientatable mast 20 having at its end a means 26 for connecting with a stringer train 28 and comprising a telescopic articulated gib 30 having a connector 32 at its end, said frame comprising underneath a connector 5 capable of locking a fixed mandrel 54 or that of a module to be positioned and comprising guide means 2 for lowering the device and means 3 for positioning it with respect to the module to be positioned, a multiconnector 6 for the electro-hydraulic connection with a multiconnector receptacle 54 carried by the module 70, electric and hydraulic umbilical ducts and cables 40 for the control and energy transmission to the multiconnector 6 and to the connector 32 and display means 33, 36.

9 Claims, 1 Drawing Figure

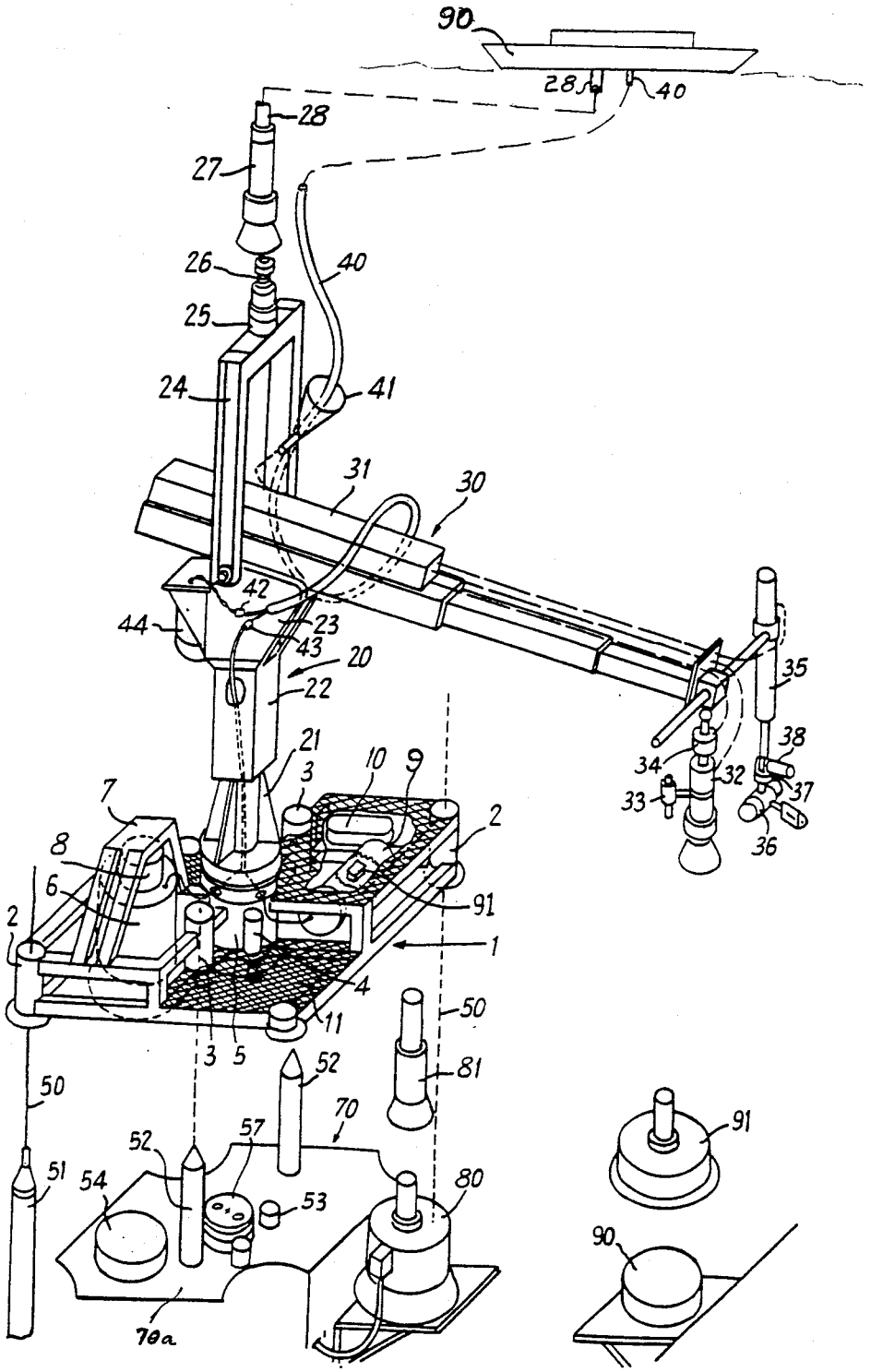
90
28
40
28
27
26
25
24
40
41
31
30
42
44
23
43
20
22
21
3
10
9
7
8
6
2
2
91
1
4
11
3
5
50
81
52
70
50
51
52
57
54
53
80
70a
91
90

DEVICE FOR POSITIONING, ACTIVATING AND CONNECTING MODULES OF A SUB-SEA OIL PRODUCTION STATION

The present invention relates to a device for positioning, activating and connecting functional modules of a sub-sea oil production station at great depth.

Such stations must be set up, maintained and monitored without direct intervention by means of automatic remote control systems.

According to U.S. Pat. Nos. 4,120,362; 4,194,875 in the name of the applicant, such a sub-sea station comprises a base frame laid on the sea bed to which are removably fixed several recoverable unitary assemblies, so as to permit maintenance and inspection thereof.

The base frame is provided with several locations for receiving modular assemblies and is also adapted for receiving lateral structures which are connected to the frame for protecting the modular assemblies and the fluid lines carried thereby.

More precisely, the locations receive, through a guide base having four guide columns, production blocks in modular form, for example a double module which comprises, stacked on guide columns of the base, equipment for a well head assembly formed from a safety block, above which is placed a production block comprising automatic and remote control equipment housed in the form of containers in housings formed in the upper face of the casing covering said production block.

The positioning and connecting operations are assisted by a robot carried by and running over rails on the lateral structures of the frame.

According to an improved design forming the subject matter of a patent application U.S. Ser. No. 673,477 filed on the same day by the applicant, the well head equipment and the control and monitoring equipment are strictly separated by grouping this latter together on a so called manifold frame. For facilitating the different connections between the modules, the modules are stacked in height in decreasing order of reliability, that is to say the connecting and monitoring modules, the less reliable central control module being disposed separately from the other modules In this new design, each modular unit such as the well head module, the connection, peripheral monitoring and central control modules, comprises a mandrel and a mechanical connector of standardized design and guide members, such as sleeves, whose geometry corresponds to that of the guide devices, such as guide columns, placed either on guide bases fixed to the frame or on underlying modules.

The aim of the invention is to replace the robot described in the above mentioned U.S. Pat. Nos. 4,120,362 and 4,194,857 by a device specially adapted to the improved design of the modules, whose fixing and locking means as well as connecting and electro-hydraulic interconnection means are standardized to the extent that the device can position the modules and activate its different means.

The device of the invention comprises a self supporting square or rectangular frame on which is mounted a central orientatable mast having at its end a means for connection with a stringer train and comprising a telescopic articulated jib having at its end an automatic mechanical action connector, said frame comprising underneath a mechanical connector capable of gripping and locking a fixed mandrel or that of a module to be positioned and comprising guide means for lowering the device to the sub-sea station and for positioning the device with respect to the module to be positioned, said device further comprising a multiconnector for the electro-hydraulic connection with a multiconnector receptacle carried by the module to be positioned, cables and electro-hydraulic umbilical ducts for energy and control transmission from the surface connected, on the one hand, to said multiconnector and, on the other, through distribution boxes to the automatic mechanical action connector situated at the end of the jib, as well as display means transmitting images to the surface and situated in the vicinity of the guide means of the automatic mechanical action connector and of the mechanical locking connector.

The means for guiding the device during lowering thereof along guide lines fastened to the guide columns fixed around the mandrel of the frame, during positioning of the device on said frame, may advantageously comprise external guide tubes placed on the four corners of the frame.

The mast is preferably composed, successively, of a fixed post secured to the frame and a rotating post suspended by an articulation to a lifting beam, which supports through a rotary stop unit a mandrel to which is connected a deconnectable mechanical connector integral with the stringer train.

The telescopic jib may rest in the fork of the lifting beam and hydraulic and electric supply ducts and cables are housed inside a sleeve of the jib.

In a variant, on the frame is disposed a hydraulic fluid reservoir connected to an electrovalve distributor controlling the operations of the crane and the action of the automatic mechanical action connector and its display means.

In this same variant, one of the umbilical hydraulic fluid distributing ducts provides through the hydraulic and electric control multiconnector the locking and unlocking action of the mechanical connection of the device to the module to be positioned and that of the module to be positioned to the mandrel of the manifold frame or to an underlying module.

In another variant, on the frame is placed an immersed central independent hydraulic unit, connected to the two electro-distributor containers to which the control cables from the surface are connected, one controlling the operation of the crane and the action of its automatic mechanical action connector, the other ensuring all the actions transiting through the multiconnector.

Furthermore, a container with equipment for the electronic processing either of the surface orders, decoding thereof and transmission to the multiconnector for distribution of the hydraulic fluid, or of information data transiting through the multiconnector for transmission thereof to the surface.

Other features of the invention will be clear from the description of the device illustrated, by way of example, by a single FIGURE showing in exploded form the way in which the device works in its sub-sea station environment.

The square self supporting structure frame 1 comprises at the four corners guide tubes 2 for guiding the device along guide lines 50 fastened to the guide columns 51 placed around a mandrel secured to the base frame of the sub-sea station.

On the top of the frame emerge two guide tubes 3 placed on each side of its center and which are intended to fit onto the guide columns 52 with which the modules are equipped and in particulur the underlying module 70 whose upper face is shown in the drawing by the reference 70*a*. This module may be a connecting module, a monitoring module or a central control module.

The purpose of the four hydraulic shock absorbers 4 placed on the frame is to soften the shocks during positioning of the device on the module by bearing on studs 53.

In the center of the underneath of frame 1 is placed a mechanical connector 5 for locking the device to the module to be positioned by means of the mandrel 57 carried by the upper face of module 70.

On the frame is also placed an electric and hydraulic control multiconnector 6 for connection to the underlying module, intended to come into contact with the receptacle of the female multiconnector placed on module 70. Multiconnector 6 is fixed inside a suspension chair 7 by means of a resilient suspension 8.

Television cameras and projectors not shown are fixed to the frame in the vicinity of connector 5 and guide tubes 4.

A central mast 20 is formed of a fixed post 21 secured to the frame on which is rotatably mounted a post 22 able to turn through a complete revolution about its axis under the effect of the action of a rotary piston and cylinder device, not shown.

On a stirrup 23 integral with post 22 is pivotably mounted a lifting beam 24 at the top of which is placed through a rotary stop unit 25 a mandrel 26 connectable through a mechanical connector 27 to the stringer train 28.

In the fork of the lifting beam 24 is placed a telescopic jib 30 with a sleeve 31 housing the electric and hydraulic supply ducts and cables.

At the end of jib 30 is placed, via a rotary piston and cylinder device 34, an automatic mechanical action connector 32 comprising its television camera 33 and a projector. At a distance from connector 32 another television camera 36 with its projector is fixed to a tube 35. This camera is capable of a double rotation through rotary piston and cylinder devices 37 and 38 with orthogonal axes.

The automatic mechanical action connector 32 is of the self locking type capable, after being activated, of transmitting through a special mandrel, with which the objects to be handled are provided, hydraulic pressures and flows. Thus, it provides both the mechanical connections and the hydraulic connections. It may be advantageously of the type forming the subject matter of a patent application filed this same day by the applicant, but any similar known tool may also be used.

In the case shown, the device is not equipped with an independent hydraulic central unit. All the electric and hydraulic controls are transmitted to the surface vessel 90 through an umbilical 40. The umbilical 40 is locked close to the lifting beam by means of an orientatable guide 41. The cables and the ducts of the umbilical 40 are separated from disconnectable connections 42, 43.

A bypass of the ducts leads to an electrovalve distributor 44 placed on the stirrup 23 for controlling, through the hydraulic fluid contained in the oleo-pneumatic accumulators 10 placed on the frame, the operations of the crane and the action of the automatic mechanical action connector 32 and its display means 33 and 36. Another bypass leads to the multiconnector 6, through which are provided all the functional actions of the module carried, such as movements of piston and cylinder devices, closure of valves and others and in particular the locking and unlocking ation of the mechanical connection of the module to be positioned with an underlying module.

Another bypass joins a hydraulic container 9 of the frame which controls in particular the locking and unlocking of the mechanical connection 5 of the device with the mandrel 57 of the module to be positioned.

The container 9 also contains electrovalve distribution equipment 91 for providing rotation of the crane and the movements of the cameras and equipment for processing data, either of the surface orders, decoding thereof and transmission to the multiconnector 6 for distribution of the hydraulic fluid, or information data transiting through the multiconnector for transmission thereof to the surface vessel 90.

Two spacers 11 and 11' are provided on the bottom floor of the chassis for stocking the protection caps for the male and female multiconnectors. Positioning of modules using the device takes place as follows. On the surface the module to be positioned is assembled with the device by causing the mechanical connector 5 carried by the device to grip the special mandrel of standard design carried by this module. Positioning is ensured by its two columns 52 fitting into the guide tubes 4 carried by the device. During this operation, the multiconnector 6 is fitted onto the female multiconnector 54 of module 70, then it is activated for taking charge of the module to be handled.

The whole thus mounted is lowered while guiding it by means of the guide lines 50 fastened to the guide columns 51 on the sea bed and also by using display means until the mechanical connector of module 70, for example a monitoring module, meets the mandrel of the connecting module on which it is to be positioned. The positioning takes place gently despite the pounding of the surface support, because of the shock absorbers 53. Locking of the monitoring module is provided through the multiconnector by the hydraulic fluid fed from this surface through the direct hydraulic umbilical. In the case where the device is equipped with an immersed independent hydraulic central unit, the hydraulic fluid of the central unit is distributed through an electrovalve distributor contained in container 9.

The actions transiting through the multiconnector are various. They comprise the vertical connections to the superimposed modules, such as locking of the underlying module with the one on which the underlying module is positioned, or else locking of the connector of the underlying module with modules adjacent the underlying module.

They may also control pressure tests with the operation of valves and feeding back the results.

The action of the automatic mechanical action connector 32 on the site of a sub-sea station is controlled from the surface control cabin and, depending on the type of remote control chosen, either through electric orders transmitted to the sea bed, or through hydraulic orders transmitting through the umbilical 40. When the device is positioned on a module, such as in the case of the example of connecting module 70, connector 32 is capable of providing all the external hydraulic or electro-hydraulic connections to the module carried, by moving connectors belonging to the modules by actuation of the crane, for example for placing the multiconnector 80 resting on a solid base connected to the connecting module 70 in a receptacle of female muliconnector 90 belonging to the well head output mandrel, after removing and placing their respective protection caps 81 and 91 on area 11 of frame 1.

Similarly, connector 32 is capable of providing the connections between the adjacent modules, for example between the central control module and respectively each peripheral monitoring module or else the central control module and the umbilical heads.

The action of connector 32 also consists in controlling a certain number of operations, such as the injection of high and low pressure fluids into the actuated members.

Subsidiarily, because of the display means, the device may control the bottom of the supported module and facilitate fitting thereof on the guide columns during positioning, thus making any other display means superfluous.

We claim:

1. In a multi-functional device for positioning, activating and interconnecting, from a surface vessel, functional connecting module (70) with a subsea production means including a subsea installation and/or subsea modules positioned on said installation, the subsea production means having guideline means (50, 51) connected to the vessel, the combination of:

a polygonal frame means (1);

means (3, 52) for positioning the frame means with respect to said connecting module (70);

means on the frame means including a mechanical connector (5) adapted to be connected to a fixed mandrel (57) on said connecting module (70);

means including an umbilical cable (40) extending from a surface vessel to the frame means (1);

a multiconnector (6) carried on the frame means and adapted to be connected to a multiconnector receptacle (54) on said connecting module (70); and means for manipulating said frame means (1) with said connecting module (70) associated therewith relative to said subsea production means and including a central mast (20) mounted on the frame means and adapted to be connected to a stringer train (28) extending from the surface vessel;

a jib means (30) carried by the central mast and having an end extendable beyond the frame means;

and an automatic mechanical connector 32 supported at said end of said jib means (30), said connector (32) being adapted to control the making of various connecions to said subsea production means.

2. The combination as claimed in claim 1 wherein said central mast (20) includes a fixed post (21) secured to said frame means (1) and a rotating post (22), a lifting beam (24) pivotally connected to and suspending said rotatable post (22), a rotary stop unit (25) on said beam (24), and a mandrel (26) adapted to be connected to a disconnectable mechanical connector (27) on said stringer train (28).

3. The combination as stated in claim 2 wherein said jib means (30) is telescopic, said lifting beam (24) having fork means for supporting said jib means, said jib means (30) having a sleeve (31) for housing electronic and hydraulic supply ducts and cables.

4. The combination as claimed in claim 1 including a rotary piston and cylinder device (34) interconnecting said end of said jib means (30) and said automatic mechanical action connector (32).

5. The combination as claimed in claim 1 including a television camera and projector (36);

a piston and cylinder device (35) supporting said television camera and projector (36) from said end of said jib means (30) in spaced relation with respect to said automatic mechanical connector (32).

6. The combination as claimed in claim 1 including a hydraulic fluid reservoir (10) and an electro-valve distributor (44) connected therewith carried by said frame means (1) and adapted to control the operations of said jib means 30, said automatic mechanical connector (32), and the display means of said camera and projector (36).

7. The combination as claimed in claim 1 wherein said umbilical cable (40) includes hydraulic fluid distribution ducts connected with said multiconnector (6) for locking and unlocking of said mechanical connector (5) of said frame means, said frame means being selectively positioned with an underlying mandrel of one of said subsea modules, for locking and unlocking of the connecting module (70) positioned with respect to one of the adjacent subsea modules.

8. The combination as claimed in claim 1 including a container (9) carried on said frame means (1) and provided with data processing equipment for electronic processing either of orders from the surface vessel, decoding thereof and transmission thereof to multi-connector (6) for distribution of hydraulic fluid or information data transmitted through the multi-connector (6) for transmission thereof to the surface.

9. A multi-purpose device for positioning, activating, and interconnecting functional modules with a subsea production means from a surface vessel, the subsea production means including guide line means (50) for guiding the device to the subsea production means; the combination of:

a polygonal frame means (1) and a connecting module unit (70) adapted to be assembled together and lowered in assembly along said guide line means (50) to the subsea production means;

a central mast (20) mounted on said frame means and including a rotatable portion (22) having means adapted to be connected to a stringer train (28) extending to the surface vessel;

a jib means (30) carried by said rotatable portion (22) and provided with a connector means (32) at its remote end;

multi-connector means carried by said frame means (1) and said module (70) adapted to be interengaged in assembly; and umbilical cable means (40) extending from the surface vessel to the frame means (1) and interconnected with said means on said frame means and said connecting module unit (70) for controlling various functions of said module unit and of said jib means and said connector means (32), whereby said device is adapted to provide control of various functions of a subsea installation on which various types of modules may be installed.

* * * * *